US010157608B2

(12) United States Patent
Ohtani et al.

(10) Patent No.: US 10,157,608 B2
(45) Date of Patent: Dec. 18, 2018

(54) DEVICE FOR PREDICTING VOICE CONVERSION MODEL, METHOD OF PREDICTING VOICE CONVERSION MODEL, AND COMPUTER PROGRAM PRODUCT

(71) Applicant: Kabushiki Kaisha Toshiba, Minato-ku, Tokyo (JP)

(72) Inventors: Yamato Ohtani, Kanagawa (JP); Yu Nasu, Tokyo (JP); Masatsune Tamura, Kangawa (JP); Masahiro Morita, Kanagawa (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 15/433,690

(22) Filed: Feb. 15, 2017

(65) Prior Publication Data

US 2017/0162187 A1 Jun. 8, 2017

Related U.S. Application Data

(63) Continuation of application No. PCT/JP2014/074581, filed on Sep. 17, 2014.

(51) Int. Cl.
*G10L 13/033* (2013.01)
*G10L 13/047* (2013.01)
(Continued)

(52) U.S. Cl.
CPC ..... *G10L 13/0335* (2013.01); *G10L 13/033* (2013.01); *G10L 13/047* (2013.01); *G10L 13/08* (2013.01); *G10L 21/003* (2013.01)

(58) Field of Classification Search
CPC ..... G10L 13/02; G10L 13/0335
(Continued)

(56) References Cited

U.S. PATENT DOCUMENTS 7,765,101 B2 7/2010 En-Najjary et al.
7,792,672 B2 9/2010 Rosec et al.
(Continued)

FOREIGN PATENT DOCUMENTS

JP 10-187187 7/1998
JP 2008-058696 3/2008
(Continued)

OTHER PUBLICATIONS

Chen et al., "Integrated Expression Prediction and Speech Synthesis From Text," IEEE Journal of Selected Topics in Signal Processing, vol. 8, Apr. 2014 in 13 pages.
(Continued)

*Primary Examiner* — Shaun Roberts
(74) *Attorney, Agent, or Firm* — Knobbe, Martens, Olson & Bear, LLP

(57) ABSTRACT

According to an embodiment, a voice processing device includes an interface system, a determining processor, and a predicting processor. The interface system configured to receive neutral voice data representing audio in a neutral voice of a user. The determining processor configured to determine a predictive parameter based at least in part on the neutral voice data. The predicting processor configured to predict a voice conversion model for converting the neutral voice of the speaker to a target voice using at least the predictive parameter.

3 Claims, 8 Drawing Sheets

(51) Int. Cl.
*G10L 13/08* (2013.01)
*G10L 21/003* (2013.01)

(58) Field of Classification Search
USPC ..... 704/258, 260
See application file for complete search history.

(56) References Cited

U.S. PATENT DOCUMENTS

| | | | | |
|---|---|---|---|---|
| 9,043,213 | B2 * | 5/2015 | Chun | G06F 17/289 704/255 |
| 2011/0087488 | A1 * | 4/2011 | Morinaka | G10L 13/033 704/207 |
| 2013/0132069 | A1 * | 5/2013 | Wouters | G06F 17/28 704/8 |
| 2013/0238337 | A1 * | 9/2013 | Kamai | G10L 21/003 704/258 |
| 2014/0114663 | A1 * | 4/2014 | Lin | G10L 13/033 704/260 |
| 2015/0046164 | A1 * | 2/2015 | Maganti | G10L 13/04 704/260 |
| 2015/0127350 | A1 * | 5/2015 | Agionnyrgiannakis | G10L 13/02 704/266 |
| 2016/0300564 | A1 | 10/2016 | Nasu et al. | |

FOREIGN PATENT DOCUMENTS

| | | |
|---|---|---|
| JP | 2011-028130 | 2/2011 |
| JP | 2011-242470 | 12/2011 |
| WO | WO 2015/092936 | 6/2015 |

OTHER PUBLICATIONS

Chen et al., "Speaker Dependent Expression Predictor from Text: Expressiveness and Transplantation," Proceedings in ICASSP, May 2014 in 5 pages.
Chen et al., "Unsupervised Speaker and Expression Factorization for Multi-Speaker Expressive Synthesis of Ebooks," Proceedings in Interspeech 2013, Aug. 25-29, 2013, pp. 1042-1045 in 5 pages.
Ohtani et al., "Emotional Transplant in Statistical Speech Synthesis Based on Emotion Additive Model," Proceedings in Interspeech, Sep. 2015, pp. 274-278 in 5 pages.
Yamagishi et al., "A Training Method of Average Voice Model for HMM-Based Speech Synthesis," IEICE Transactions on Fundamentals of Electronics, Communication and Computer Sciences vol. E86-A, No. 8, 2003, pp. 1956-1963, in 8 pages.
Yamagishi et al., "Average-Voice-Based Speech Synthesis Using HSMM-Based Speaker Adaptation and Adaptive Training," IEICE Transactions on Information and Systems vol. E90-D No. 2, Feb. 2007, pp. 533-543 in 11 pages.
International Search Report dated Dec. 22, 2014 in PCT Application No. PCT/JP2014/074581, 7pgs.

* cited by examiner

DEVICE FOR PREDICTING VOICE CONVERSION MODEL, METHOD OF PREDICTING VOICE CONVERSION MODEL, AND COMPUTER PROGRAM PRODUCT

CROSS-REFERENCE TO RELATED APPLICATIONS

This application is a continuation of PCT international application Ser. No. PCT/JP2014/074581 filed on Sep. 17, 2014 which designates the United States; the entire contents of which are incorporated herein by reference.

FIELD

Embodiments described herein relate generally to a voice processing device, a voice processing method, and a computer program product.

BACKGROUND

Voice synthesis is known that converts any input text to a voice and outputs the voice. Voice synthesis requires a voice model representing prosody and phonemes of the voice. A voice synthesis technique using the hidden Markov model is known as a technique for statistically creating the voice model.

In the voice synthesis using the hidden Markov model, a hidden Markov model is trained using a parameter representing a prosody parameter, a voice spectrum, and others extracted from a voice waveform of a target speaker and context representing a language attribute such as a phoneme and grammar. This process can generate a synthesized voice in which vocal sound and a voice of a target speaker are reproduced. Furthermore, in the voice synthesis based on the hidden Markov model, parameters relating to a voice are modeled, which allows various types of processing to be done in more flexible manner. For example, a voice model for a target voice of a speaker can be created with the speaker adaptation technique using an existing voice model and a small amount of voice data representing the target voice of the speaker.

DETAILED DESCRIPTION

According to an embodiment, a voice processing device includes an interface system, a determining processor, and a predicting processor. The interface system is configured to receive neutral voice data representing audio in a neutral voice of a user. The determining processor, implemented in computer hardware, configured to determine a predictive parameter based at least in part on the neutral voice data. The predicting processor, implemented in computer hardware, configured to predict a voice conversion model for converting the neutral voice of the speaker to a target voice using at least the predictive parameter.

Various embodiments will be described below with reference to the accompanying drawings.

First Embodiment

Figure 1:
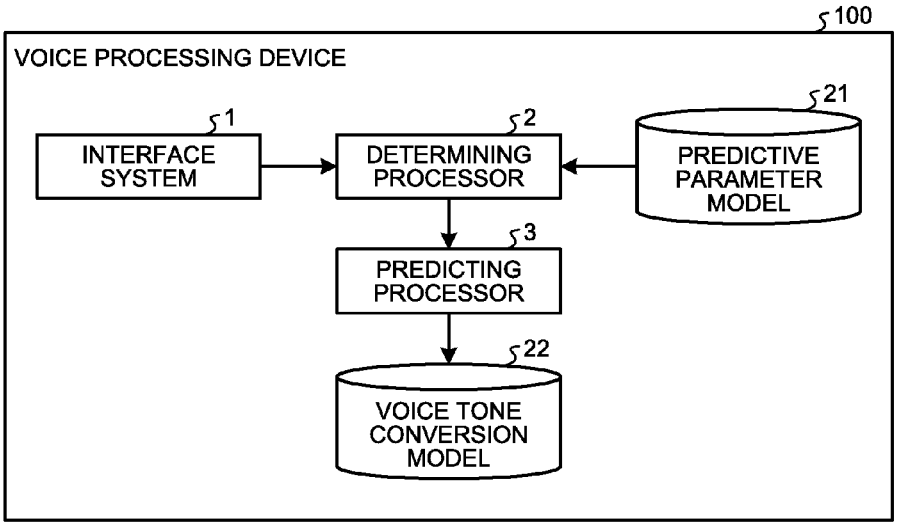
FIG. 1 is a drawing illustrating an exemplary configuration of a voice processing device according to a first embodiment.

FIG. 1 is a drawing illustrating an exemplary configuration of a voice processing device 100 according to a first embodiment. The voice processing device 100 of the first embodiment includes an interface system 1, a determining processor 2, and a predicting processor 3. The voice processing device 100 of the first embodiment stores a predictive parameter model 21 and a voice conversion model 22 in a memory (not illustrated in FIG. 1). The predictive parameter model 21 is preliminarily stored in the memory of the voice processing device 100, whereas the voice conversion model 22 is stored by the predicting processor 3.

The interface system 1 receives neutral voice data representing a voice in a neutral voice of a speaker. Neutral voice data of the first embodiment provides a voice model representing features of a voice in the neutral voice of the speaker. The voice model is a probability model in which a parameter extracted from acoustic feature quantity data is statistically modeled based on the context (language attribute data). The acoustic feature quantity data includes, for example, prosody, duration of speech, and a voice spectrum representing phonemes and vocal sound.

Examples of the voice model include a hidden Markov model (HMM) and a hidden semi-Markov model (HSMM). In the first embodiment, the explanation is given for a case in which the neutral voice data is an HSMM.

The interface system 1 transmits neutral voice data (HSMM) to the determining processor 2 and the predicting processor 3.

The determining processor 2 receives the neutral voice data (HSMM) from the interface system 1. The determining processor 2 determines a predictive parameter from the predictive parameter model 21 based on the neutral voice data (HSMM).

The predictive parameter model 21 will now be described.

Figure 2:
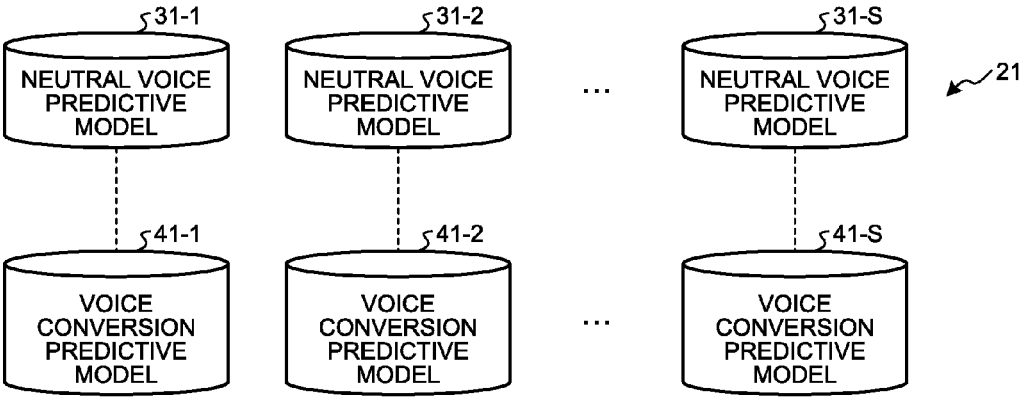
FIG. 2 is a drawing illustrating an exemplary configuration of a predictive parameter model according to the first embodiment.

FIG. 2 is a drawing illustrating an exemplary configuration of the predictive parameter model 21 according to the first embodiment. The predictive parameter model 21 includes a plurality of neutral voice predictive models 31 (a neutral voice predictive model 31-1, a neutral voice predictive model 31-2, . . . , and a neutral voice predictive model 31-S) and voice conversion predictive models 41 (a voice conversion predictive model 41-1, a voice conversion predictive model 41-2, . . . , and a voice conversion predictive model 41-S). Each of the neutral voice predictive models 31 is associated with the voice conversion predictive model 41 optimized for converting the neutral voice predictive model to a voice model of a target voice.

The neutral voice predictive model 31-1, the neutral voice predictive model 31-2, . . . , and the neutral voice predictive model 31-S are voice models of neutral voices of S speakers. The neutral voice predictive model 31 is an HSMM trained from, for example, acoustic feature quantity data of a neutral voice of a speaker and language attribute data of the neutral voice of the speaker. The neutral voice predictive model 31 may be configured with an HSMM generated using the speaker adaptation technique and a decision tree for distribution selection that are described in Junichi YAMAGISHI and Takao KOBAYASHI "Average-Voice-Based Speech Synthesis Using HSMM-Based Speaker Adaptation and Adaptive Training", IEICE TRANSACTIONS on Information and Systems Vol. E90-D No. 2, p. 533-543, 2007 (Hereinafter, referred to as "Non Patent Literature 1").

The voice conversion predictive model 41 is a model trained with the cluster adaptive training (CAT) described in Langzhou Chen, Norbert Braunschweiler, "Unsupervised Speaker and Expression Factorization for Multi-Speaker Expressive Synthesis of Ebooks", Proceedings in Interspeech 2013, p. 1042-1045, 2013 (hereinafter, referred to as "Non Patent Literature 2"), using acoustic feature quantity data of one type of voice (a voice converted from a neutral voice will be hereinafter referred to as a "target voice") converted from a neutral voice and language attribute data of one type of target voice. The voice conversion predictive model 41 is a model with two clusters including a bias cluster. More specifically, the voice conversion predictive model 41 is a model trained with constraint to obtain a model parameter with the bias cluster fixed to a voice model representing a neutral voice and the other cluster representing the difference between the neutral voice and the target voice.

In the example of FIG. 2, the neutral voice predictive model 31 and the voice conversion predictive model 41 are associated with each other on a one-to-one basis. In another case, one neutral voice predictive model 31 may be associated with two or more types of voice conversion predictive models 41. The number of clusters of the voice conversion predictive model 41 is the sum of the number of target voices and a bias cluster. As is the case of using one type of target voice, the voice conversion predictive model 41 is a model trained with constraint to obtain a model parameter with each cluster representing the difference between the neutral voice and a target voice thereof.

Referring back to FIG. 1, how the determining processor 2 determines a predictive parameter will be described. The determining processor 2 calculates the distance between the neutral voice data (HSMM) and the neutral voice predictive model 31 using a certain distance function. More specifically, the determining processor 2 calculates the distance between the neutral voice data (HSMM) and the neutral voice predictive model 31 using the distance between a mean vector of the neutral voice data (HSMM) and a mean vector of the neutral voice predictive model 31.

The distance function is a function for calculating an Euclidean distance, a Mahalanobis distance, a Bhattacharyya distance, a Hellinger distance, and the like. As a scale that is substituted for the distance function, the symmetric Kullback-Leibler divergence may be used.

The determining processor 2 determines a neutral voice predictive model 31 the distance of which is closest to the neutral voice data (HSMM) to be a neutral voice predictive model 31 most similar to the neutral voice data (HSMM). The determining processor 2 then determines a voice conversion predictive model 41 associated with the neutral voice predictive model 31 the distance of which is closest to the neutral voice data (HSMM) to be a predictive parameter.

The determining processor 2 may determine the predictive parameter using one distance function or using a plurality of distance functions. The determining processor 2 may determine the predictive parameter using a plurality of distance functions by weighting the distance, placing a priority on the distance, or the like, obtained by each distance function.

The determining processor 2 transmits the predictive parameter to the predicting processor 3.

The predicting processor 3 receives the predictive parameter from the determining processor 2. Using the predictive parameter, the predicting processor 3 predicts the voice conversion model 22 with which the neutral voice data (HSMM) is converted to a target voice.

Figure 3:
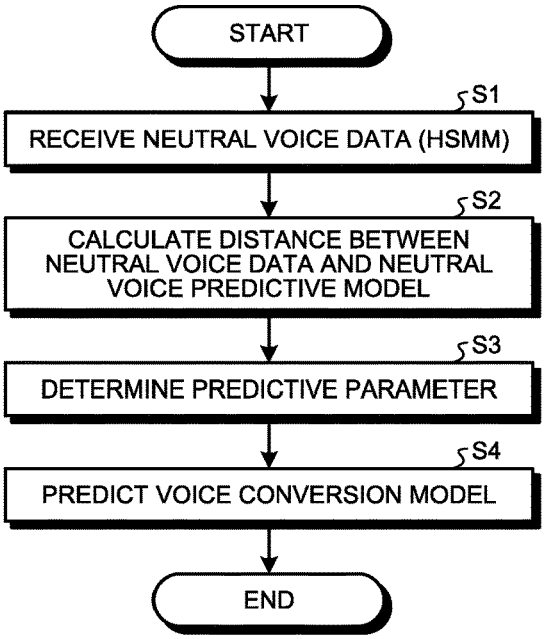
FIG. 3 is a flowchart illustrating an exemplary method of voice processing according to the first embodiment.

FIG. 3 is a flowchart illustrating an exemplary method of voice processing according to the first embodiment. The interface system 1 receives the neutral voice data (HSMM) representing a voice in a neutral voice of a speaker (Step S1). The determining processor 2 then calculates the distance between the neutral voice data (HSMM) and the neutral voice predictive model 31 using a certain distance function (Step S2). The determining processor 2 further then determines a voice conversion predictive model 41 associated with the neutral voice predictive model 31 the distance of which is closest to the neutral voice data (HSMM) to be a predictive parameter (Step S3). Using the predictive parameter, the predicting processor 3 then predicts the voice conversion model 22 with which the neutral voice data (HSMM) is converted to a target voice (Step S4).

As described above, in the voice processing device 100 according to the first embodiment, the determining processor 2 determines a voice conversion predictive model 41 associated with the neutral voice predictive model 31 the distance of which is closest to the neutral voice data (HSMM) to be a predictive parameter. Using the predictive parameter, the predicting processor 3 predicts the voice conversion model 22 with which a neutral voice of the speaker is converted to a target voice. This makes it possible to prevent deterioration of the quality of an output synthesized voice even when the neutral voice data (HSMM) of any speaker is converted to data representing a different voice using the speaker adaptation technique.

Modification of First Embodiment

A modification of the first embodiment will now be described. The voice processing device 100 according to the modification of the first embodiment is different from the voice processing device 100 of the first embodiment in the format of the neutral voice data received by the interface system 1. The voice processing device 100 of the modification of the first embodiment has the same configuration (see FIG. 1) as that of the voice processing device 100 in the first embodiment, and description thereof will be thus omitted. The modification of the first embodiment will be described focusing on points different from the first embodiment.

The interface system 1 receives neutral voice data representing a voice in a neutral voice of a speaker. The neutral voice data of the modification of the first embodiment includes acoustic feature quantity data of the voice in the neutral voice of the speaker and language attribute data of the voice in the neutral voice.

The acoustic feature quantity data is data representing features of a voice obtained by analyzing the voice. More specifically, the acoustic feature quantity data provides a parameter relating to prosody extracted from a voice of a speech and a parameter extracted from a voice spectrum representing phonemes and vocal sound. The parameter relating to prosody is a time sequence of a basic frequency representing a voice pitch. The parameter representing phonemes and vocal sound is a time sequence of the cepstrum, the mel-cepstrum, the LPC, the mel-LPC, the LSP, the mel-LSP, and the like, an index indicating the ratio between periodicity and non-periodicity of the voice, and a feature quantity representing a time change of these pieces of acoustic data.

The language attribute data is data representing a language attribute obtained by analyzing a voice or text. For example, the language attribute data is data obtained from information of a character string of a spoken voice. More specifically, the language attribute data includes phonemes, information about a manner of pronunciation, the position of a phrase end, the length of a sentence, the length of a breath group, the position of a breath group, the length of an accentual phrase, the position of an accentual phrase, the length of a word, the position of a word, the length of a mora, the position of a mora, an accent type, information of dependency, information of grammar, information of a phoneme boundary relating to a precedent feature, the one before the precedent feature, a subsequent feature, the one after the subsequent feature, and the like.

The determining processor 2 receives neutral voice data (acoustic feature quantity data and language attribute data) from the interface system 1. The determining processor 2 determines a predictive parameter from the predictive parameter model 21 based on the neutral voice data (the acoustic feature quantity data and the language attribute data).

Specifically, the determining processor 2 calculates likelihood of the neutral voice predictive model 31 with respect to the neutral voice data (the acoustic feature quantity data and the language attribute data).

The likelihood is an index quantifying how much a statistic model coincides with input data. The likelihood is represented as the probability $P(\lambda|X)$ ($\lambda$: a model parameter, X: data).

The determining processor 2 determines a voice conversion predictive model 41 associated with the neutral voice predictive model 31 selected based on the likelihood to be a predictive parameter. In other words, the determining processor 2 determines a voice conversion predictive model 41 associated with the neutral voice predictive model 31 having the highest likelihood with respect to the neutral voice data (the acoustic feature quantity data and language attribute data) to be the predictive parameter.

The predicting processor 3 receives the predictive parameter from the determining processor 2. Using the predictive parameter, the predicting processor 3 predicts the voice conversion model 22 with which the neutral voice data (the acoustic feature quantity data and the language attribute data) is converted to a target voice.

As described above, in the voice processing device 100 according to the modification of the first embodiment, the determining processor 2 determines a voice conversion predictive model 41 associated with the neutral voice predictive model 31 having the highest likelihood with respect to the neutral voice data (the acoustic feature quantity data and the language attribute data) to be a predictive parameter. Using the predictive parameter, the predicting processor 3 predicts the voice conversion model 22 with which a neutral voice of the speaker is converted to a target voice. This makes it possible to prevent deterioration of the quality of an output synthesized voice even when the neutral voice data (the acoustic feature quantity data and the language attribute data) of any speaker is converted to data representing a different voice using the speaker adaptation technique.

Second Embodiment

A second embodiment will now be described. The voice processing device 100 of the second embodiment is different from the voice processing device 100 of the first embodiment in the method of determination of a predictive parameter by the determining processor 2. The voice processing device 100 of the second embodiment has the same configuration (see FIG. 1) as that of the voice processing device 100 in the first embodiment, and description thereof is thus omitted. The second embodiment will be described focusing on points different from the first embodiment.

The determining processor 2 receives neutral voice data (HSMM) from the interface system 1. The determining processor 2 determines a predictive parameter from the predictive parameter model 21 based on the neutral voice data (HSMM). More specifically, the determining processor 2 determines a predictive parameter adapted to the neutral voice data (HSMM) from the neutral voice predictive model 31 and the voice conversion predictive model 41 using a certain prediction function.

Examples of the prediction function include a linear transformation function such as multiple regression and affine transformation and non-linear transformation function such as kernel regression and a neural network. Such a prediction function may be used that determines a predictive parameter predicting two or more different types of voice conversion models 22 together.

In the second embodiment, the explanation is given for a case in which a predictive parameter for predicting one type of voice conversion model 22 is determined using a linear transformation function of multiple regression as the certain prediction function.

In the case of using a linear transformation of multiple regression, it is assumed that the structures of neutral voice predictive models 31 of S speakers coincide with one another. In other words, it is assumed that the number of parameters of all the neutral voice predictive models 31 and their correspondence are uniquely determined. The neutral voice predictive models 31 in the second embodiment are thus assumed to be constructed with speaker adaptation using maximum likelihood linear regression.

Likewise, in the case of using a linear transformation with multiple regression, it is assumed that the structures of the voice conversion predictive models 41 of the respective speakers coincide with one another. The voice conversion predictive models 41 in the second embodiment are thus created from voice data of target voices of S speakers and voice models of neutral voices by performing shared decision tree based context clustering described in Non Patent Literature 1 on the voice data of target voices of S speakers and voice models of neutral voices and sharing the model structure.

A method of determining a predictive parameter of the second embodiment will now be described.

Figure 4:
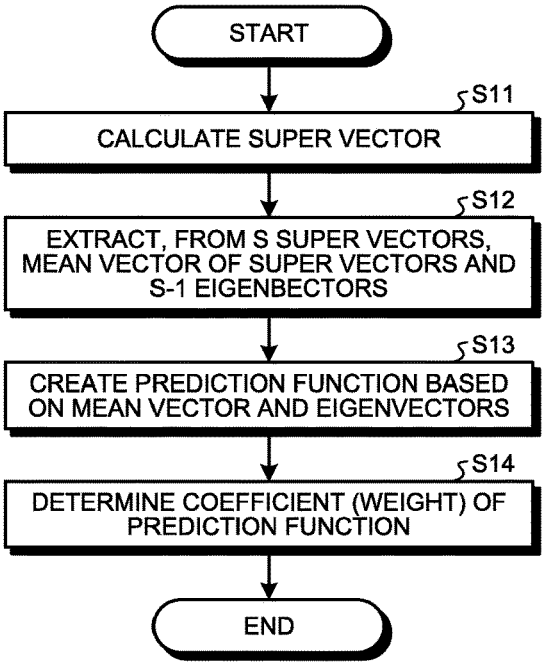
FIG. 4 is a flowchart illustrating an exemplary method of determining a predictive parameter according to a second embodiment.

FIG. 4 is a flowchart illustrating an exemplary method of determining a predictive parameter according to the second embodiment. The determining processor 2 calculates a super vector (Step S11). Specifically, the determining processor 2 extracts a parameter relating to a mean of the neutral voice predictive model 31-1 and a parameter relating to a mean of the voice conversion predictive model 41-1. The determining processor 2 combines the parameter relating to the mean of the neutral voice predictive model 31-1 and the parameter relating to the mean of the voice conversion predictive model 41-1 so as to calculate a super vector indicating a mean of the neutral voice predictive model 31-1 and the voice conversion predictive model 41-1. Likewise, the determining processor 2 calculates super vectors for the neutral voice predictive model 31-2 and the voice conversion predictive model 41-2, . . . , and the neutral voice predictive model 31-S and the voice conversion predictive model 41-S.

The determining processor 2 performs eigenvalue decomposition or singular value decomposition on the S super vectors so as to extract a mean vector (a bias vector) of the super vectors and S-1 eigenvectors (Step S12). The determining processor 2 then creates a prediction function as Expression (1) below based on the mean vector and the eigenvectors (Step S13).

$$\begin{bmatrix} \mu_b \\ \mu_c \end{bmatrix} = \sum_{s=1}^{S-1} w^{(s)} \begin{bmatrix} e_b^{(s)} \\ e_c^{(s)} \end{bmatrix} + \begin{bmatrix} e_b^{(0)} \\ e_c^{(0)} \end{bmatrix} \tag{1}$$

In Expression (1), $\mu_b$ is a mean vector of the neutral voice data (HSMM); $\mu_c$ is a mean vector of the voice conversion model 22; $e_b^{(s)}$ is the s-th eigenvector of the neutral voice predictive model 31; $e_c^{(s)}$ is the s-th eigenvector of the voice conversion predictive model 41; $e_b^{(0)}$ is a bias vector indicating a component of a dimension corresponding to the neutral voice predictive model 31; $e_c^{(0)}$ is a bias vector indicating a component of a dimension corresponding to the voice conversion predictive model 41; and $w^{(s)}$ is a coefficient (weight) of the s-th eigenvector.

The determining processor 2 then determines a coefficient (weight) $w^{(s)}$ of the prediction function represented by Expression (1) (Step S14). More specifically, the determining processor 2 determines a combination (Expression (3) below) of the coefficient (weight) $w^{(s)}$ in the prediction function using Expression (2) below.

$$\hat{w} = \arg\min_{W} \left\| \mu_b - \left( \sum_{s=1}^{S-1} w^{(s)} e_b^{(s)} + e_b^{(0)} \right) \right\| \tag{2}$$

$$W = \{w^{(1)}, w^{(2)}, \ldots, w^{(S-1)}\} \tag{3}$$

The determining processor 2 determines the weight w(s) such that the difference between the mean vector $\mu_b$ of the neutral voice data (HSMM) and the linear sum (see the first component in the right side of Expression (1)) of the eigenvector $e_b$ of the neutral voice predictive model 31 and the bias vector $e_b^{(0)}$ of the neutral voice predictive model 31 becomes smallest.

The predicting processor 3 predicts the mean vector $\mu_c$ of the voice conversion model 22 from the combination (Expression (3)) of the coefficient (weight) $w^{(s)}$ in the prediction function determined by Expression (2) and from Expression (1). That is, the predicting processor 3 predicts the mean vector $\mu_c$ of the voice conversion model 22 using a prediction function represented by Expression (4) below.

$$\hat{\mu}_c = \sum_{s=1}^{S-1} \hat{w}^{(s)} e_c^{(s)} + e_c^{(0)} \tag{4}$$

Figure 5:
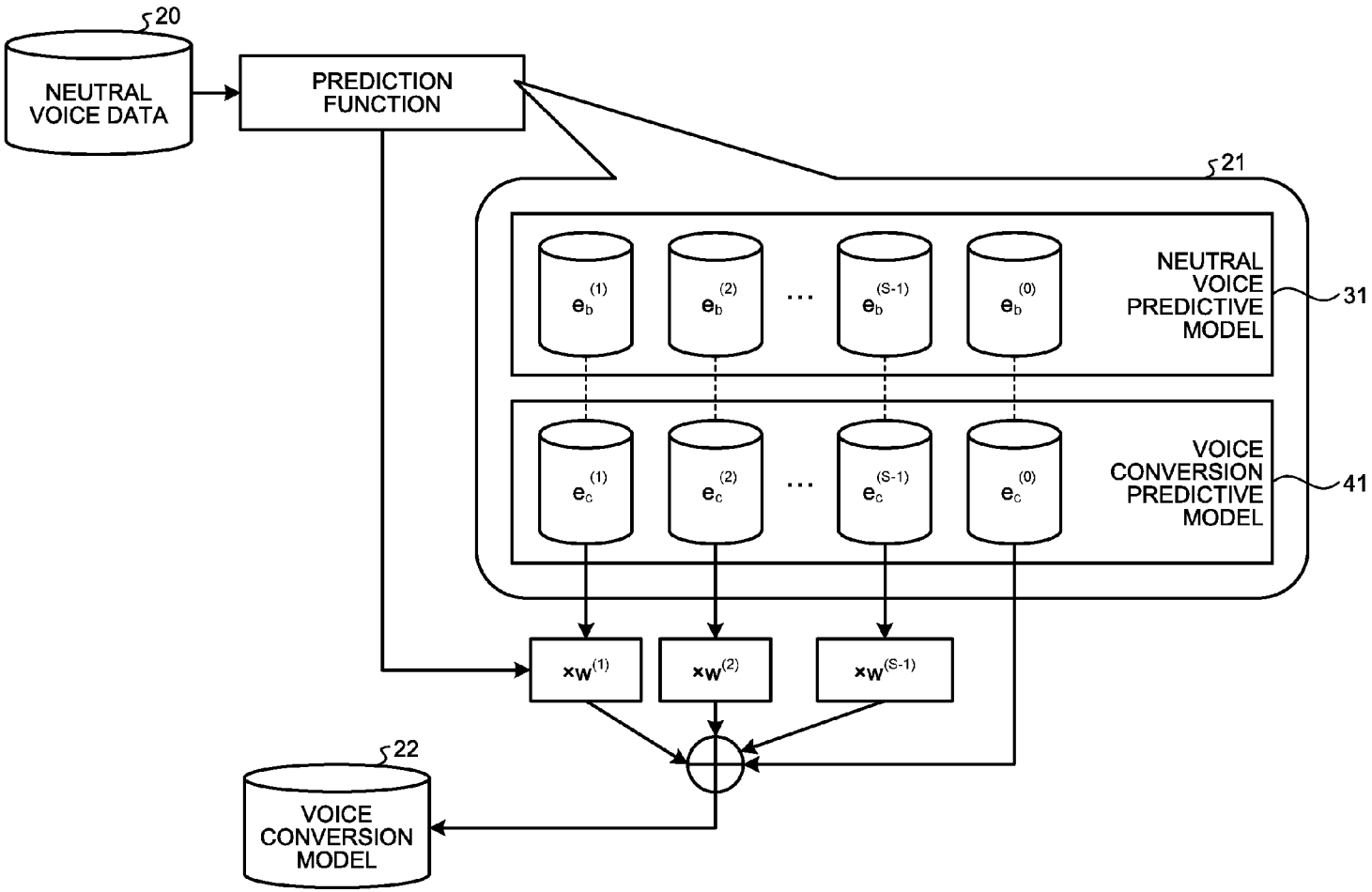
FIG. 5 is a conceptual drawing of a prediction function according to the second embodiment.

FIG. 5 is a conceptual drawing of a prediction function according to the second embodiment. The determining processor 2 determines the prediction function (Expression (4)) for predicting the voice conversion model 22 of the neutral voice data (HSMM) from a plurality of neutral voice predictive models 31 and a plurality of voice conversion predictive models 41 based on the neutral voice data 20 to be a predictive parameter. Using the predictive parameter, the predicting processor 3 predicts the voice conversion model 22 for converting a neutral voice of a speaker to a target voice.

As described above, the voice processing device 100 according to the second embodiment can prevent deterioration of the quality of an output synthesized voice even when the neutral voice data (HSMM) of any speaker is converted to data representing a different voice using the speaker adaptation technique.

Modification of Second Embodiment

A modification of the second embodiment will now be described. The voice processing device 100 of the modification of the second embodiment is different from the voice processing device 100 of the second embodiment in the format of the neutral voice data received by the interface system 1. The voice processing device 100 of the modification of the second embodiment has the same configuration (see FIG. 1) as that of the voice processing device 100 in the first embodiment, and description thereof is thus omitted. The modification of the second embodiment will be described focusing on points different from the second embodiment.

The interface system 1 receives neutral voice data representing a voice in a neutral voice of a speaker. The neutral voice data in the modification of the second embodiment includes acoustic feature quantity data of the voice in the neutral voice of the speaker and language attribute data of the voice in the neutral voice. Description of the acoustic feature quantity data and the language attribute data is the same as that in the modification of the first embodiment, and repeated description is thus omitted.

The determining processor 2 receives neutral voice data (acoustic feature quantity data and language attribute data) from the interface system 1. The determining processor 2 determines a predictive parameter from the predictive parameter model 21 based on the neutral voice data (the acoustic feature quantity data and the language attribute data).

Specifically, as is the case with the voice processing device 100 of the second embodiment, the determining processor 2 creates a prediction function of Expression (1). The determining processor 2 of the modification of the second embodiment determines a combination (Expression (3)) of the weight $w^{(s)}$ such that the likelihood becomes highest using Expressions (5) and (6) below by applying the cluster adaptive training described in Non Patent Literature 2.

$$\hat{W} = \operatorname{argmax}_{W} P(X \mid \lambda, W) \tag{5}$$

-continued $$P(X \mid \lambda, W) = N\left(X; \sum_{s=1}^{S-1} w^{(s)} e_b^{(s)} + e_b^{(0)}, \sum\right) \tag{6}$$

In Expression (6), N(;) represents the normal distribution; and Σ represents a covariance matrix.

The predicting processor 3 predicts the mean vector $\mu_c$ of the voice conversion model 22 from the combination (Expression (3)) of the coefficient (weight) $w^{(s)}$ in the prediction function determined by Expressions (5) and (6) and from Expression (1). That is, the predicting processor 3 predicts the mean vector $\mu_c$ of the voice conversion model 22 using Expression (4).

As described above, in the voice processing device 100 of the modification of the second embodiment, the determining processor 2 determines a predictive parameter for predicting the voice conversion model 22 of neutral voice data (the acoustic feature quantity data and the language attribute data) from a plurality of neutral voice predictive models 31 and a plurality of voice conversion predictive models 41 based on the neutral voice data. Using the predictive parameter, the predicting processor 3 predicts the voice conversion model 22 for converting a neutral voice of a speaker to a target voice. This makes it possible to prevent deterioration of the quality of an output synthesized voice even when the neutral voice data (the acoustic feature quantity data and the language attribute data) of any speaker is converted to data representing a different voice using the speaker adaptation technique.

Third Embodiment

A third embodiment will now be described. The voice processing device 100 according to the third embodiment synthesizes a voice using the voice conversion model 22 created by the processing of the determining processor 2 and the predicting processor 3 in the first embodiment, the modification of the first embodiment, the second embodiment, and the modification of the second embodiment.

Figure 6:
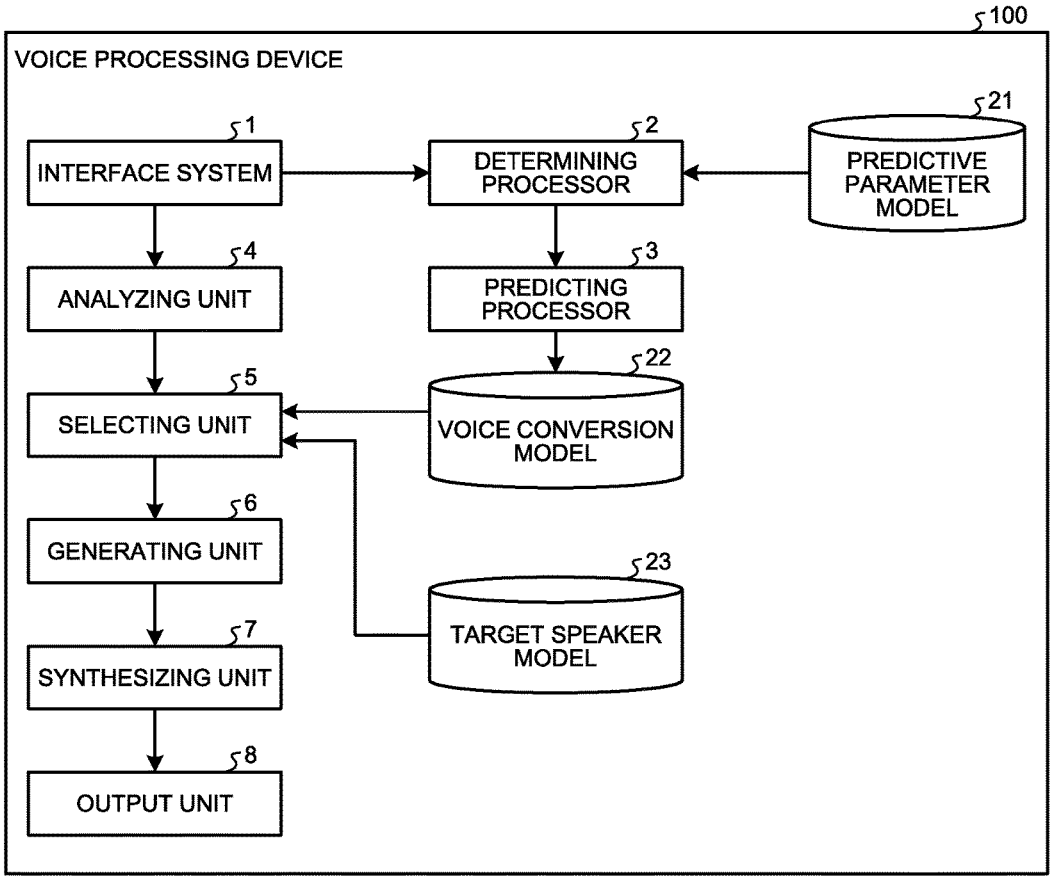
FIG. 6 is a drawing illustrating an exemplary configuration of a voice processing device according to a third embodiment.

FIG. 6 is a drawing illustrating an exemplary configuration of the voice processing device 100 according to the third embodiment. The voice processing device 100 of the third embodiment includes the interface system 1, the determining processor 2, the predicting processor 3, an analyzing unit 4, a selecting unit 5, a generating unit 6, a synthesizing unit 7, and an output unit 8. The voice processing device 100 of the third embodiment further stores the predictive parameter model 21, the voice conversion model 22, and a target speaker model 23 in a memory unit (not illustrated in FIG. 6).

The interface system 1 receives text data or neutral voice data. The text data is data representing any character string. The neutral voice data provides an HSMM or acoustic feature quantity data and language attribute data.

Upon receipt of neutral voice data by the interface system 1, the voice conversion model 22 is created by the processing of the determining processor 2 and the predicting processor 3. The processing of the determining processor 2 and the predicting processor 3 is the same as that in the first embodiment, the modification of the first embodiment, the second embodiment, and the modification of the second embodiment, and description thereof will be thus omitted.

The interface system 1 receives the text data and transmits the text data to the analyzing unit 4.

The analyzing unit 4 receives the text data from the interface system 1. The analyzing unit 4 analyzes the text data and acquires the above-described language attribute data. The analyzing unit 4 transmits the language attribute data to the selecting unit 5.

The selecting unit 5 receives the language attribute data from the analyzing unit 4. The selecting unit 5 selects a model parameter from the voice conversion model 22 and the target speaker model 23 based on the language attribute data using a certain decision tree.

The voice conversion model 22 is associated with the target speaker model 23 representing a voice model of a neutral voice of the target speaker. In other words, the voice conversion model 22 is a model parameter for converting the voice model (the target speaker model 23) of the neutral voice of the target speaker to a target voice.

The voice processing device 100 may include a plurality of voice conversion models 22. With this configuration, a voice in a different voice can be synthesized in response to an operation input instructing the type of a voice from a user. Likewise, the voice processing device 100 may include a plurality of target speaker models 23.

The selecting unit 5 transmits the model parameter to the generating unit 6.

The generating unit 6 receives the model parameter from the selecting unit 5. The generating unit 6 generates a voice parameter based on the model parameter. The generating unit 6 generates a voice parameter from the model parameter using, for example, the method described in Non Patent Literature 2. The generating unit 6 transmits the voice parameter to the synthesizing unit 7.

The synthesizing unit 7 receives the voice parameter from the generating unit 6. The synthesizing unit 7 synthesizes a voice waveform from the voice parameter and transmits the voice waveform to the output unit 8.

The output unit 8 receives the voice waveform from the synthesizing unit 7 and outputs a voice corresponding to the voice waveform. The output unit 8 outputs the voice, for example, as an audio file. The output unit 8 further outputs the voice through an audio outputting device such as a speaker.

A method of voice processing according to the third embodiment will now be described.

Figure 7:
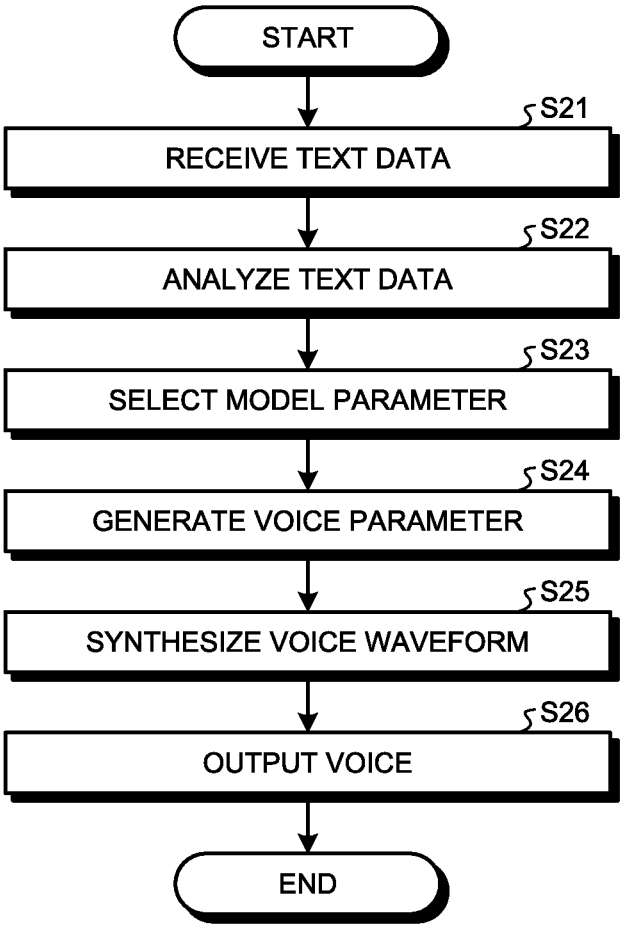
FIG. 7 is a flowchart illustrating an exemplary method of voice processing according to the third embodiment.

FIG. 7 is a flowchart illustrating an exemplary method of voice processing according to the third embodiment. The interface system 1 receives text data (Step S21). The analyzing unit 4 analyzes the text data and acquires the above-described language attribute data (Step S22). The selecting unit 5 selects a model parameter from the voice conversion model 22 and the target speaker model 23 based on the language attribute data using a certain decision tree (Step S23). The generating unit 6 generates a voice parameter based on the model parameter (Step S24). The synthesizing unit 7 synthesizes a voice waveform from the voice parameter (Step S25). The output unit 8 outputs a voice corresponding to the voice waveform (Step S26).

As described above, with the voice processing device 100 according to the third embodiment, a voice can be synthesized from text data using the voice conversion model 22 created by the determining processor 2 and the predicting processor 3 of the first embodiment, the modification of the first embodiment, the second embodiment, and the modification of the second embodiment.

Fourth Embodiment

A fourth embodiment will now be described. The voice processing device 100 of the fourth embodiment converts a voice of input voice data to a target voice and outputs converted voice data. The voice conversion model 22 created by the processing of the determining processor 2 and the predicting processor 3 in the modification of the first embodiment or the modification of the second embodiment is used in this process.

Figure 8:
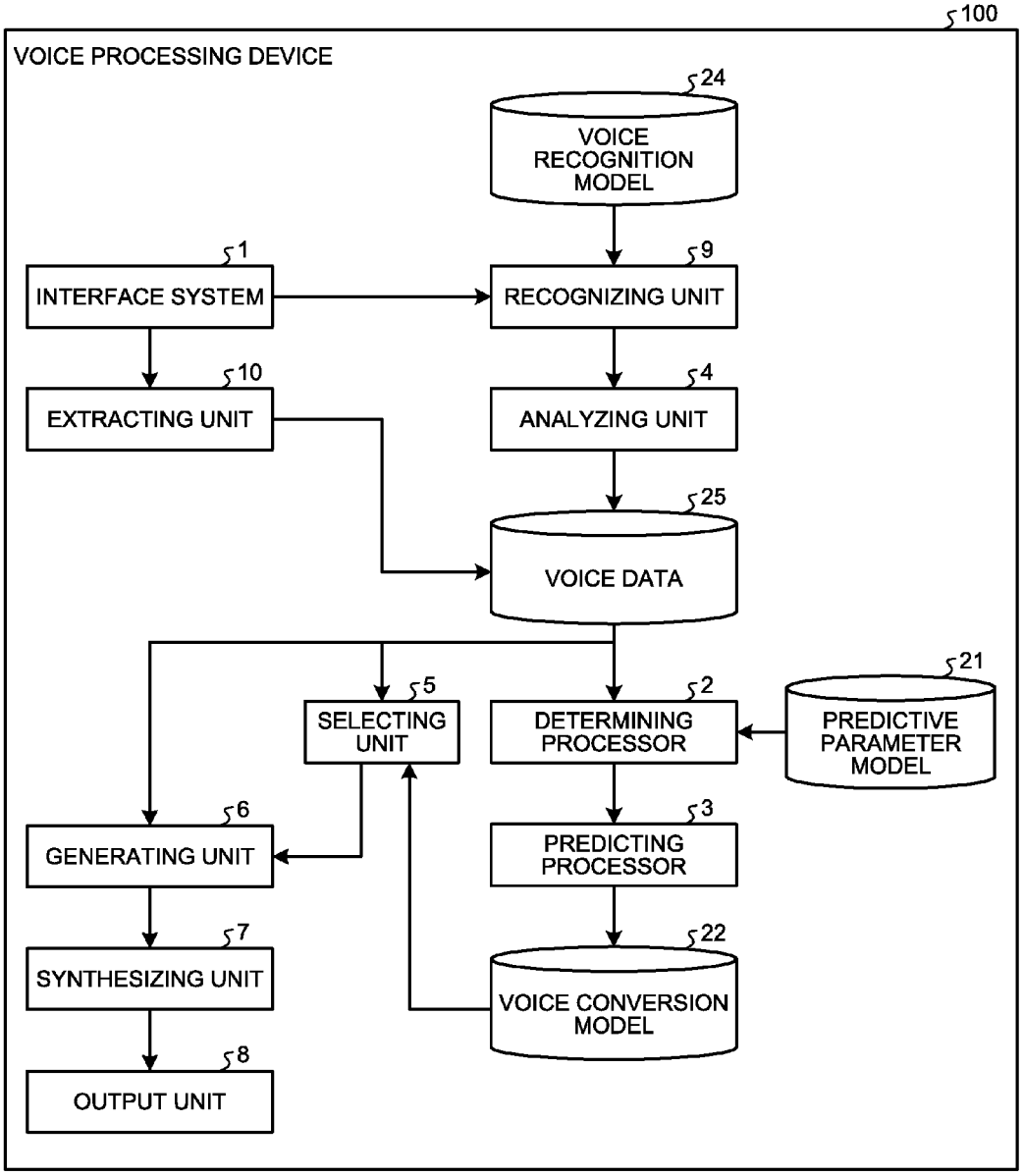
FIG. 8 is a drawing illustrating an exemplary configuration of a voice processing device according to a fourth embodiment.

FIG. 8 is a drawing illustrating an exemplary configuration of the voice processing device 100 according to the fourth embodiment. The voice processing device 100 of the fourth embodiment includes the interface system 1, the determining processor 2, the predicting processor 3, the analyzing unit 4, the selecting unit 5, the generating unit 6, the synthesizing unit 7, the output unit 8, a recognizing unit 9, and an extracting unit 10. The voice processing device 100 of the fourth embodiment further stores the predictive parameter model 21, the voice conversion model 22, a voice recognition model 24, and voice data 25 in a memory unit (not illustrated in FIG. 8).

The interface system 1 receives voice data including any speech content. The interface system 1 receives the voice data from an audio inputting device such as a microphone. The interface system 1 receives the voice data, for example, as an audio file. The interface system 1 transmits the voice data to the recognizing unit 9 and the extracting unit 10.

The recognizing unit 9 receives the voice data from the interface system 1. The recognizing unit 9 performs voice recognition using the voice recognition model 24 so as to acquire text data from the voice data. The voice recognition model 24 is model data necessary for recognizing text data from voice data. The recognizing unit 9 further recognizes a time boundary between phonemes and acquires phoneme boundary information indicating a time boundary of phonemes. The recognizing unit 9 transmits the text data and the phoneme boundary information to the analyzing unit 4.

The analyzing unit 4 receives the text data and the phoneme boundary information from the recognizing unit 9. The analyzing unit 4 analyzes the text data and acquires the above-described language attribute data. The analyzing unit 4 associates the language attribute data with the phoneme boundary information.

The extracting unit 10 receives the voice data from the interface system 1. The extracting unit 10 extracts, from the voice data, acoustic feature quantity data including a parameter (a time sequence of a basic frequency representing a voice pitch) relating to prosody or a parameter (the cepstrum, for example) relating to the prosody and vocal sound.

The vocal data 25 stores therein the text data and the phoneme boundary information recognized by the recognizing unit 9, the language attribute data acquired by the analyzing unit 4, and the acoustic feature quantity data extracted by the extracting unit 10.

The determining processor 2 determines a predictive parameter from the predictive parameter model 21 based on the language attribute data and the acoustic feature quantity data stored in the voice data 25. The processing for determining the predictive parameter by the determining processor 2 is the same as that by the determining processor 2 in the modification of the first embodiment and the modification of the second embodiment, and description thereof will be thus omitted. The determining processor 2 transmits the predictive parameter to the predicting processor 3.

The predicting processor 3 receives the predictive parameter from the determining processor 2 and predicts the voice conversion model 22 for converting a voice represented by the voice data 25 to a target voice using the predictive parameter. The processing for predicting the voice conversion model 22 by the predicting processor 3 is the same as that by the predicting processor 3 in the modification of the first embodiment and the modification of the second embodiment, and description thereof will be thus omitted.

The selecting unit 5 selects a model parameter from the voice conversion model 22 based on the language attribute data included in the voice data 25. The selecting unit 5 arranges the model parameter in a time sequence as a model parameter sequence based on phoneme boundary information associated with the language attribute data of the voice data 25.

The generating unit 6 adds the model parameter sequence to the time sequence of the acoustic feature quantity data included in the voice data 25 so as to generate a voice parameter representing a voice to which a voice of the voice data received by the interface system 1 is converted.

The model parameter sequence is a sequence that discretely changes upon a change in the types of model parameter, and the discrete change exerts effects on the acoustic feature quantity data to which the model parameter has been added. To reduce the effects, the generating unit 6 performs smoothing processing using a feature quantity included in the acoustic feature quantity data and representing a time change. Examples of the smoothing processing include a method of generating a voice parameter according to the maximum likelihood criteria used in Non Patent Literature 1 and Non Patent Literature 2 and the Kalman filter and Kalman smoother used in a linear dynamical system. In this case, distributed information in each frame of the acoustic feature quantity data is necessary, and any distributed information may be determined.

The generating unit 6 transmits the voice parameter to the synthesizing unit 7.

The synthesizing unit 7 receives the voice parameter from the generating unit 6. The synthesizing unit 7 synthesizes a voice waveform from the voice parameter and transmits the voice waveform to the output unit 8.

The output unit 8 receives the voice waveform from the synthesizing unit 7 and outputs a voice corresponding to the voice waveform. The output unit 8 outputs the voice, for example, as an audio file. The output unit 8 further outputs the voice through an audio outputting device such as a speaker.

A method of voice processing in the fourth embodiment will now be described.

Figure 9:
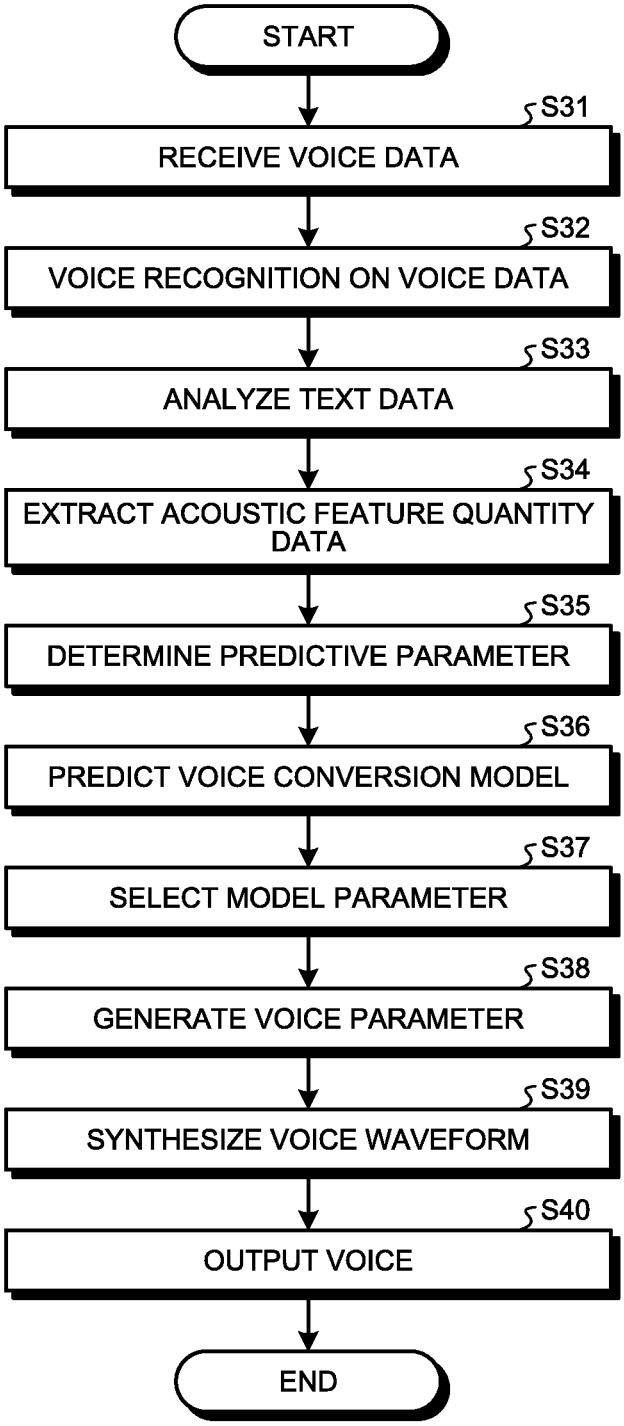
FIG. 9 is a flowchart illustrating an exemplary method of voice processing according to the fourth embodiment.

FIG. 9 is a flowchart illustrating an exemplary method of voice processing according to the fourth embodiment. The interface system 1 receives voice data including speech content (Step S31).

Subsequently, the recognizing unit 9 performs voice recognition on the voice data (Step S32). More specifically, the recognizing unit 9 performs voice recognition using the voice recognition model 24 and acquires text data from the voice data. The recognizing unit 9 further recognizes a time boundary between phonemes and acquires phoneme boundary information indicating a time boundary of phonemes.

Subsequently, the analyzing unit 4 analyzes the text data (Step S33). More specifically, the analyzing unit 4 analyzes the text data and acquires the above-described language attribute data. The analyzing unit 4 associates the language attribute data with the phoneme boundary information.

Subsequently, the extracting unit 10 extracts, from the voice data, acoustic feature quantity data including a parameter (a time sequence of a basic frequency representing a voice pitch) relating to prosody or a parameter (the cepstrum, for example) relating to the prosody and vocal sound (Step S34).

Subsequently, the determining processor 2 determines a predictive parameter from the predictive parameter model 21 based on the language attribute data and the acoustic feature quantity data (Step S35). Using the predictive parameter, the predicting processor 3 predicts the voice conversion model 22 for converting a voice represented by the voice data 25 to a target voice (Step S36).

Subsequently, the selecting unit 5 selects a model parameter from the voice conversion model 22 (Step S37). More specifically, the selecting unit 5 selects a model parameter from the voice conversion model 22 based on the language attribute data included in the voice data 25. The selecting unit 5 arranges the model parameter in a time sequence as a model parameter sequence based on phoneme boundary information associated with the language attribute data of the voice data 25.

Subsequently, the generating unit 6 adds a model parameter sequence to the time sequence of the acoustic feature quantity data included in the voice data 25 so as to generate a voice parameter representing a voice to which a voice of the voice data received at Step S31 is converted (Step S38).

Subsequently, the synthesizing unit 7 synthesizes a voice waveform from the voice parameter (Step S39). The output unit 8 thereafter outputs a voice corresponding to the voice waveform (Step S40).

As described above, the voice processing device 100 according to the fourth embodiment can convert the voice of an input voice using the voice conversion model 22 created by the determining processor 2 and the predicting processor 3 in the modification of the first embodiment or the modification of the second embodiment and output the voice.

The processing of the recognizing unit 9, the analyzing unit 4, the determining processor 2, and the predicting processor 3 may be performed on a real-time basis or may be preliminarily performed.

The voice data 25 may be stored as a voice model such as an HSMM. The processing of the determining processor 2 and the predicting processor 3 in this case is the same as that in the voice processing device 100 in the first embodiment and the second embodiment.

An exemplary hardware configuration of the voice processing device 100 in the first to the fourth embodiments will now be described.

Figure 10:
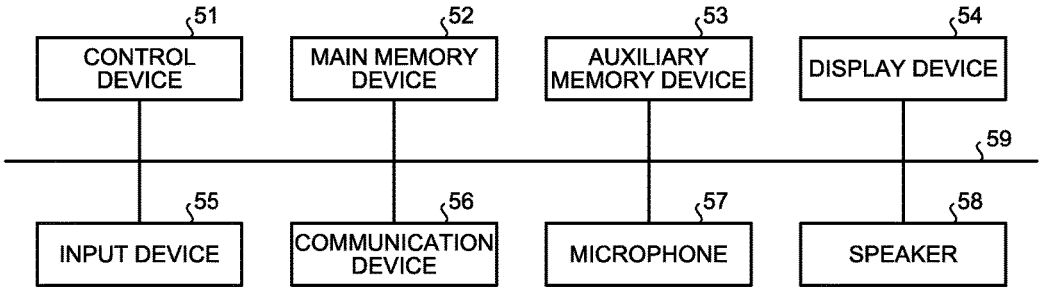
FIG. 10 is a drawing illustrating an exemplary hardware configuration of the voice processing device according to the first to the fourth embodiments.

FIG. 10 is a drawing illustrating an exemplary hardware configuration of the voice processing device 100 according to the first to the fourth embodiments. The voice processing device 100 in the first to the fourth embodiments includes a control device 51, a main memory device 52, an auxiliary memory device 53, a display device 54, an input device 55, a communication device 56, a microphone 57, and a speaker 58. The control device 51, the main memory device 52, the auxiliary memory device 53, the display device 54, the input device 55, the communication device 56, the microphone 57, and the speaker 58 are connected with one another via a bus 59.

The control device 51 executes a computer program read from the auxiliary memory device 53 onto the main memory device 52. The main memory device 52 is a memory such as a read only memory (ROM) and a random access memory (RAM). The auxiliary memory device 53 is a hard disk drive (HDD), an optical drive, or the like.

The display device 54 displays the status and others of the voice processing device 100. Examples of the display device 54 include a liquid crystal display. The input device 55 is an interface for operating the voice processing device 100. Examples of the input device 55 include a keyboard and a mouse. The communication device 56 is an interface for connecting the device to a network.

The microphone 57 captures voices, and the speaker 58 outputs the voices.

The computer program executed by the voice processing device 100 in the first to the fourth embodiments is recorded in a computer-readable memory medium such as a CD-ROM, a memory card, a CD-R, and a digital versatile disc (DVD) as an installable or executable file and provided as a computer program product.

The computer program executed by the voice processing device 100 in the first to the fourth embodiments may be stored in a computer connected to a network such as the Internet and provided by being downloaded via the network. In another manner, the computer program executed by the voice processing device 100 in the first to the fourth embodiments may be provided via a network such as the Internet without being downloaded.

The computer program of the voice processing device 100 in the first to the fourth embodiments may be provided by being preliminarily embedded in a ROM or the like.

The structure of the computer program executed by the voice processing device 100 in the first to the fourth embodiments is modularized including the above-described functional blocks (the interface system 1, the determining processor 2, the predicting processor 3, the analyzing unit 4, the selecting unit 5, the generating unit 6, the synthesizing unit 7, the output unit 8, the recognizing unit 9, and the extracting unit 10). As actual hardware, each of the functional blocks is loaded onto the main memory device 52 with the control device 51 reading the computer program from the above-described memory medium and executing the computer program and is generated on the main memory device 52. A part of or the whole of the above-described functional blocks may be implemented by hardware such as an integrated circuit (IC) instead of being implemented by software.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A device for predicting a voice conversion model, the device comprising:

an interface system configured to receive neutral voice data representing audio in a neutral voice of a user;

a determining processor, implemented in computer hardware, configured to determine a predictive parameter based at least in part on the neutral voice data; and a predicting processor, implemented in computer hardware, configured to predict a voice conversion model for converting the neutral voice of the speaker to a target voice tone using at least the predictive parameter, wherein a plurality of neutral voice predictive models are respectively associated with voice conversion predictive models each of which is optimized for converting the corresponding neutral voice predictive model to a voice model of the target voice, the neutral voice data comprises acoustic feature quantity data representing a feature of the voice obtained by analyzing the audio in the neutral voice of the user and language attribute date representing an attribute of a language obtained by analyzing the audio in the neutral voice of the user, and the determining processor is configured to:

calculate a likelihood of a linear sum of a vector based at least in part on the neutral voice predictive models with respect to the acoustic feature quantity data and the language attribute data, determine, as a weight, a coefficient of the linear sum comprising the highest calculated likelihood, and determine the predictive parameter generated by adding, to a model parameter of each voice conversion predictive model, the weight determined with respect to the corresponding neutral voice predictive model.

2. A method of predicting a voice conversion model, the method comprising:

receiving, by an interface system, neutral voice data representing audio in a calm voice tone of a user;

determining, by a determining processor implemented in computer hardware, a predictive parameter based at least in part on the neutral voice data; and predicting, by a predicting processor implemented in computer hardware, a voice conversion model for converting the neutral voice of the speaker to a target voice using at least the predictive parameter, wherein a plurality of neutral voice predictive models are respectively associated with voice conversion predictive models each of which is optimized for converting the corresponding neutral voice predictive model to a voice model of the target voice, the neutral voice data comprises acoustic feature quantity data representing a feature of the voice obtained by analyzing the audio in the neutral voice of the user and language attribute date representing an attribute of a language obtained by analyzing the audio in the neutral voice of the user, and the determining includes:

calculating a likelihood of a linear sum of a vector based at least in part on the neutral voice predictive models with respect to the acoustic feature quantity data and the language attribute data, determining, as a weight, a coefficient of the linear sum comprising the highest calculated likelihood, and determining the predictive parameter generated by adding, to a model parameter of each voice conversion predictive model, the weight determined with respect to the corresponding neutral voice predictive model.

3. A computer program product comprising a non-transitory computer-readable medium containing a computer program that causes a computer to function as:

an interface system configured to receive neutral voice data representing audio in a neutral voice of a user;

a determining processor configured to determine a predictive parameter at least in part on the neutral voice data; and a predicting processor configured to predict a voice conversion model for converting the neutral voice of the speaker to a target voice, wherein a plurality of neutral voice predictive models are respectively associated with voice conversion predictive models each of which is optimized for converting the corresponding neutral voice predictive model to a voice model of the target voice, the neutral voice data comprises acoustic feature quantity data representing a feature of the voice obtained by analyzing the audio in the neutral voice of the user and language attribute date representing an attribute of a language obtained by analyzing the audio in the neutral voice of the user, and the determining processor is configured to:

calculate a likelihood of a linear sum of a vector based at least in part on the neutral voice predictive models with respect to the acoustic feature quantity data and the language attribute data, determine, as a weight, a coefficient of the linear sum comprising the highest calculated likelihood, and determine the predictive parameter generated by adding, to a model parameter of each voice conversion predictive model, the weight determined with respect to the corresponding neutral voice predictive model.

* * * * *